US011788242B1

(12) United States Patent
Spikes

(10) Patent No.: US 11,788,242 B1
(45) Date of Patent: Oct. 17, 2023

(54) PICKUP STICK ASSEMBLIES

(71) Applicant: Larry Spikes, Marshall, TX (US)

(72) Inventor: Larry Spikes, Marshall, TX (US)

( * ) Notice: Subject to any disclaimer, the term of this patent is extended or adjusted under 35 U.S.C. 154(b) by 0 days.

(21) Appl. No.: 17/844,297

(22) Filed: Jun. 20, 2022

(51) Int. Cl.
*A01D 9/06* (2006.01)
*E01H 1/12* (2006.01)

(52) U.S. Cl.
CPC ..... *E01H 1/12* (2013.01); *E01H 2001/1233* (2013.01); *E01H 2001/1293* (2013.01)

(58) Field of Classification Search
CPC ..... E01H 1/12; E01H 1/1206; F41A 23/08; G01T 1/02
USPC ..... 294/61, 182, 175, 210
See application file for complete search history.

(56) References Cited

U.S. PATENT DOCUMENTS 481,691 A 8/1892 Currie, Jr. et al.
1,808,891 A 10/1929 Hamren
2,465,024 A 3/1949 Ludt
2,500,647 A * 3/1950 Schulthess ..... E01H 1/12 294/61
2,804,336 A 8/1957 Thompson
3,183,031 A 5/1965 Haberstick
3,633,958 A * 1/1972 Mesrobian ..... A01D 51/00 294/61
4,502,722 A 3/1985 Rocquin
4,655,495 A 4/1987 Naff, Jr.
5,370,433 A 12/1994 Yost
5,642,911 A * 7/1997 Gatch ..... E01H 1/12 294/61
6,457,758 B1 10/2002 Gerdes
8,167,310 B2 5/2012 Ruggiero
8,544,918 B1 10/2013 Feringa
9,033,385 B2 5/2015 Sgroi, Jr.
2012/0019018 A1 1/2012 Malaga
2016/0114477 A1 4/2016 Saccoccio et al.

* cited by examiner

*Primary Examiner* — Paul T Chin
(74) *Attorney, Agent, or Firm* — R. Keith Harrison

(57) ABSTRACT

Pickup stick assemblies suitable for picking up objects and discharging the retrieved objects into a trash or other receptacle may include an assembly housing having a proximal housing end and a distal housing end. A spring retaining member may be disposed between the proximal housing end and the distal housing end. An assembly shaft may be slidably disposed in the assembly housing. The assembly shaft may have a proximal assembly shaft end protruding beyond the proximal housing end of the assembly housing and a distal assembly shaft end opposite the proximal assembly shaft end. The assembly shaft may be deployable in an extended shaft position in which the distal assembly shaft end protrudes beyond the distal housing end of the assembly housing and a retracted shaft position in which the distal assembly shaft end is recessed with respect to the distal housing end of the assembly housing. A shaft retention spring may be provided in the assembly housing. The shaft retention spring may engage the spring retaining member and the assembly shaft to normally bias the assembly shaft in the extended shaft position. At least one object retaining member may be provided on the assembly shaft at the distal assembly shaft end.

20 Claims, 11 Drawing Sheets

PICKUP STICK ASSEMBLIES

FIELD

Illustrative embodiments of the disclosure relate to retrieval tools for retrieving trash and other objects, and more particularly, to pickup stick assemblies suitable for picking up objects and discharging the retrieved objects into a trash or other receptacle.

SUMMARY

Illustrative embodiments of the disclosure are generally directed to pickup stick assemblies suitable for picking up objects and discharging the retrieved objects into a trash or other receptacle. An illustrative embodiment of the pickup stick assemblies may include an assembly housing having a proximal housing end and a distal housing end. A spring retaining member may be disposed between the proximal housing end and the distal housing end. An assembly shaft may be slidably disposed in the assembly housing. The assembly shaft may have a proximal assembly shaft end protruding beyond the proximal housing end of the assembly housing and a distal assembly shaft end opposite the proximal assembly shaft end. The assembly shaft may be deployable in an extended shaft position in which the distal assembly shaft end protrudes beyond the distal housing end of the assembly housing and a retracted shaft position in which the distal assembly shat end is recessed with respect to the distal housing end of the assembly housing. A shaft retention spring may be provided in the assembly housing. The shaft retention spring may engage the spring retaining member and the assembly shaft to normally bias the assembly shaft in the extended shaft position. At least one object retaining member may be provided on the assembly shaft at the distal assembly shaft end.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 8:
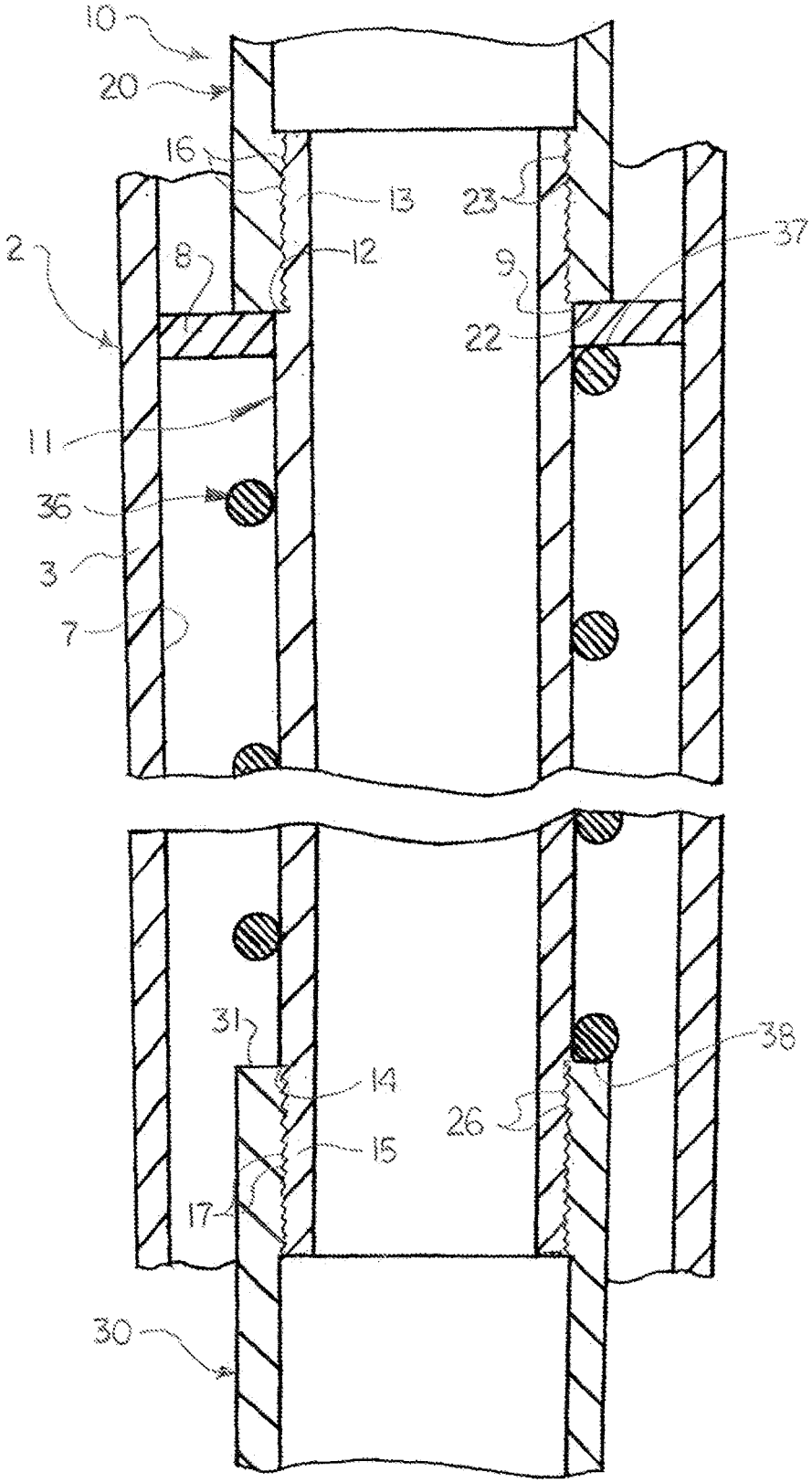
FIG. 8 is an enlarged sectional view of the assembly shaft disposed in the assembly housing and the shaft return spring in the expanded position in the object-retrieving configuration of the assembly.
Figure 9:
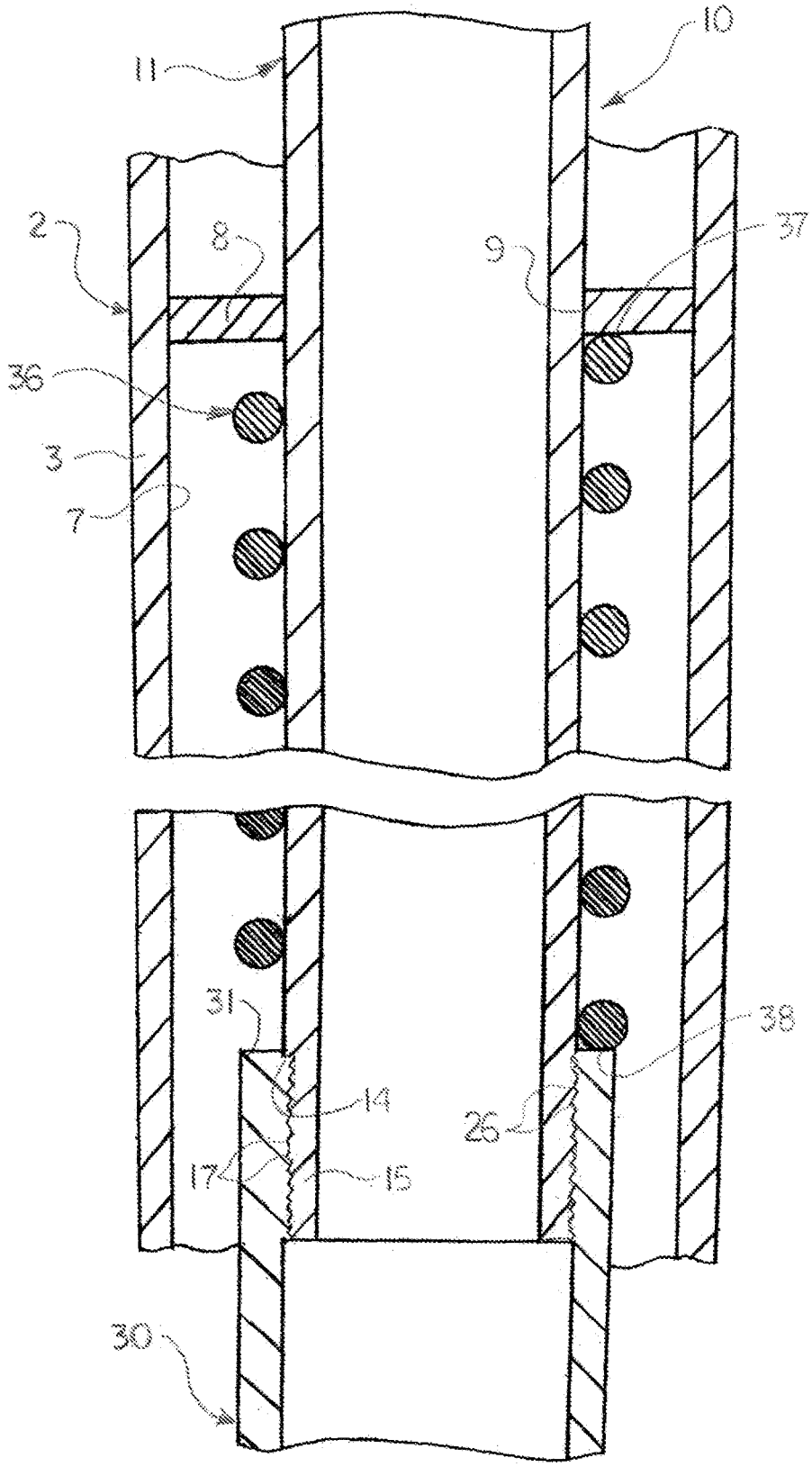
FIG. 9 is an enlarged sectional view of the assembly shaft disposed in the assembly housing and the shaft return spring in the compressed position in the object-discharging configuration of the assembly.
Figure 11:
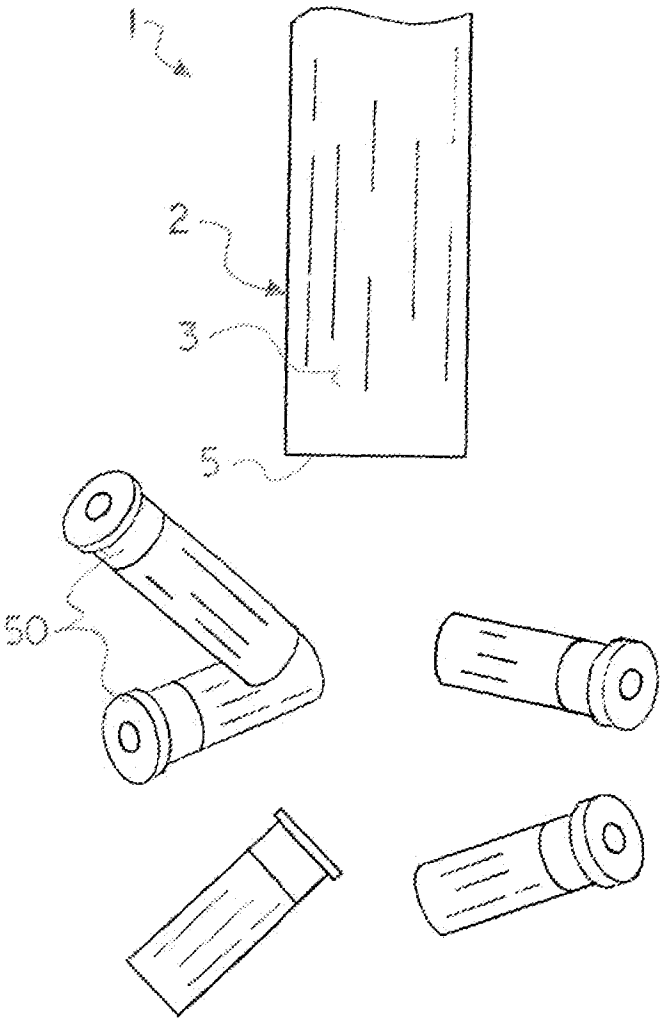
FIG. 11 is an enlarged sectional view of the assembly housing as the assembly shaft is retracted into the assembly housing to discharge the shotgun shells from the assembly shaft in the object-discharging configuration of the pickup stick assembly.
Figure 10:
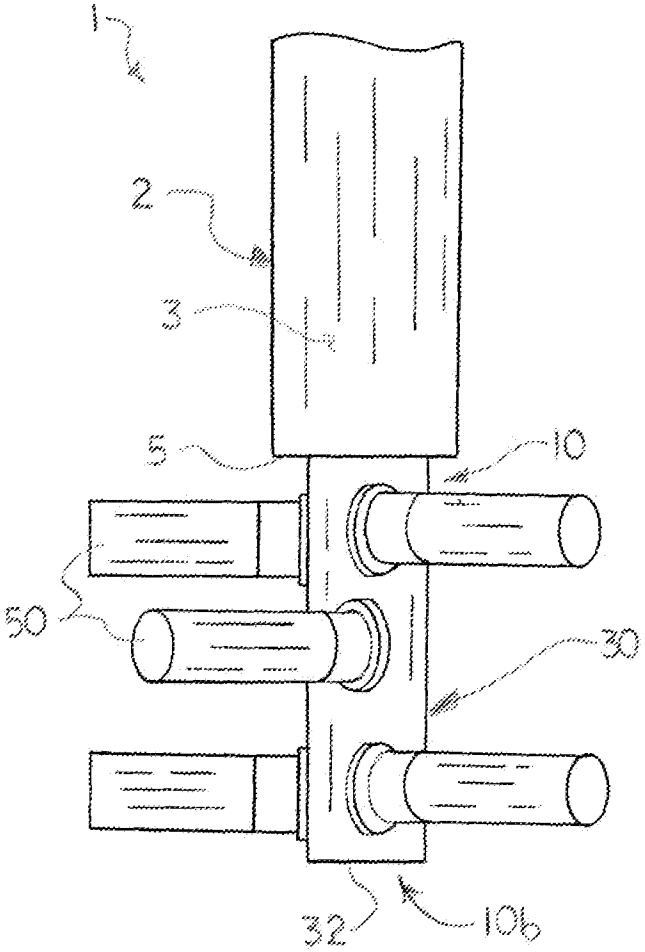
FIG. 10 is an enlarged sectional view of the assembly shaft extending from the assembly housing in the object-retrieving configuration of the pickup stick assembly, with multiple shotgun shells magnetically attached to the assembly shaft in typical application of the assembly.

Referring initially to FIGS. 1-11 of the drawings, an illustrative embodiment of the pickup stick assembly is generally indicated by reference numeral 1. As illustrated in FIGS. 10 and 11, in typical application, which will be hereinafter further described, the pickup stick assembly 1 may be operated to pick up objects 50 such as spent shotgun shells, for example and without limitation, from the ground and deposit or discharge the objects 50 into a trash or other receptacle (not illustrated) without the need of the operator to squat or bend over to retrieve the objects 50 with the operator's hands.

As illustrated in FIGS. 1-9, the pickup stick assembly 1 may include an assembly housing 2. The assembly housing 2 may have a proximal housing end 4 and a distal housing end 5. As illustrated in FIGS. 5, 6, 8 and 9, a spring retaining member 8, the purpose of which will be hereinafter described, may be disposed between the proximal housing end 4 and the distal housing end 5 of the assembly housing 2.

An assembly shaft 10 may be slidably disposed in the assembly housing 2. The assembly shaft 10 may have a proximal assembly shaft end 10*a* which protrudes beyond the proximal housing end 4 of the assembly housing 2 and a distal assembly shaft end 10*b* opposite the proximal assembly shaft end 10*a*. The assembly shaft 10 may be deployable in an extended shaft position (FIGS. 1 and 5) in which the distal assembly shaft end 10*b* protrudes beyond the distal housing end 5 of the assembly housing 2 and a retracted shaft position (FIGS. 2 and 6) in which the distal assembly shaft end 10*b* is recessed with respect to the distal housing end 5 of the assembly housing 2.

As illustrated in FIGS. 3-6, 8 and 9, a shaft retention spring 36 may be disposed in the assembly housing 2. The shaft retention spring 36 may engage the spring retaining member 8 and the assembly shaft 10 to normally bias the assembly shaft 10 in the extended shaft position. In operation of the pickup stick assembly 1, which will be hereinafter described, the assembly shaft 10 in the extended shaft position may initially be used to pick up the objects 50 from the ground. The assembly shaft 10 may then be selectively deployed from the extended shaft position to the retracted shaft position, against the bias imparted by the shaft retention spring 36, to discharge the retrieved objects 50 from the assembly shaft 10.

The assembly housing 2 and assembly shaft 10 of the pickup stick assembly 1 may be fabricated of steel, aluminum, other metals, composite materials, high density plastics, or combinations thereof using casting, molding, machining and/or other fabrication techniques known by those skilled in the art.

At least one object retaining member 42 may be provided on the assembly shaft 10 at the distal assembly shaft end 10*b*. The object retaining member 42 may facilitate retention of the objects 50 on the assembly shaft 10 for subsequent discharge of the objects 50 from the assembly shaft 10 typically into a trash or other receptacle (not illustrated). For example and without limitation, as illustrated in FIGS. 3 and 5-7, in some embodiments, the object retaining member 42 may include at least one pickup magnet 44.

As illustrated in FIGS. 1-6, a handle 24 may be provided on the proximal assembly shaft end 10*a* of the assembly shaft 10. The handle 24 may enable the operator of the pickup stick assembly 1 to grasp and manually deploy the assembly shaft 10 with respect to the assembly housing 2 from the extended shaft position to the retracted shaft position.

Figure 5:
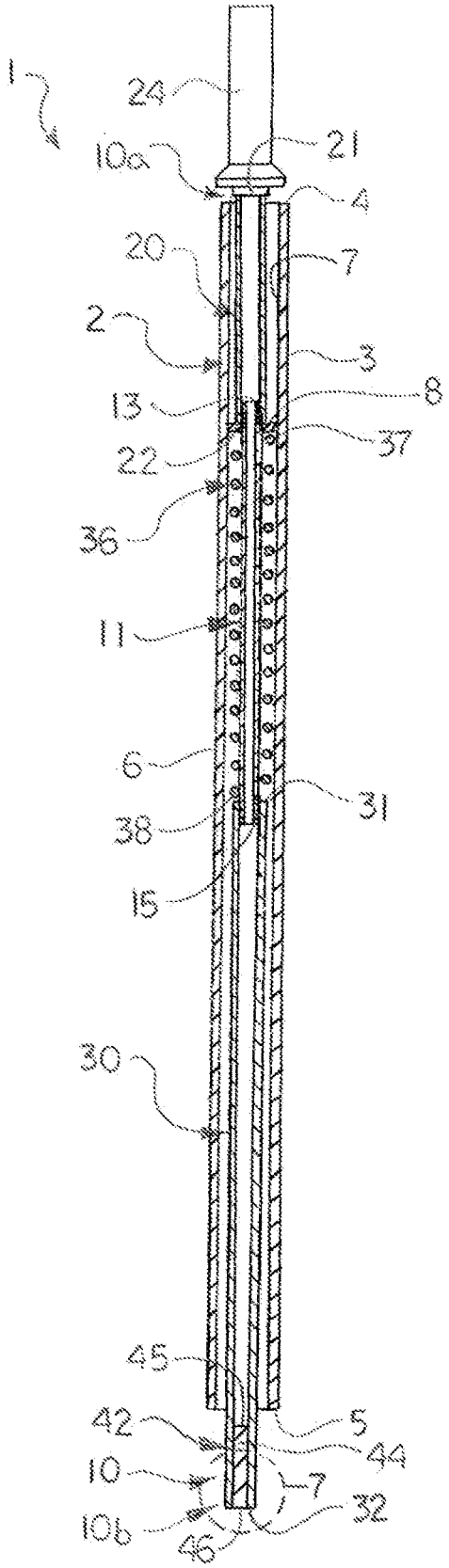
FIG. 5 is a longitudinal sectional view, taken along section lines 5-5 in FIG. 1, of the illustrative pickup stick assembly in the object-retrieving configuration.
Figure 6:
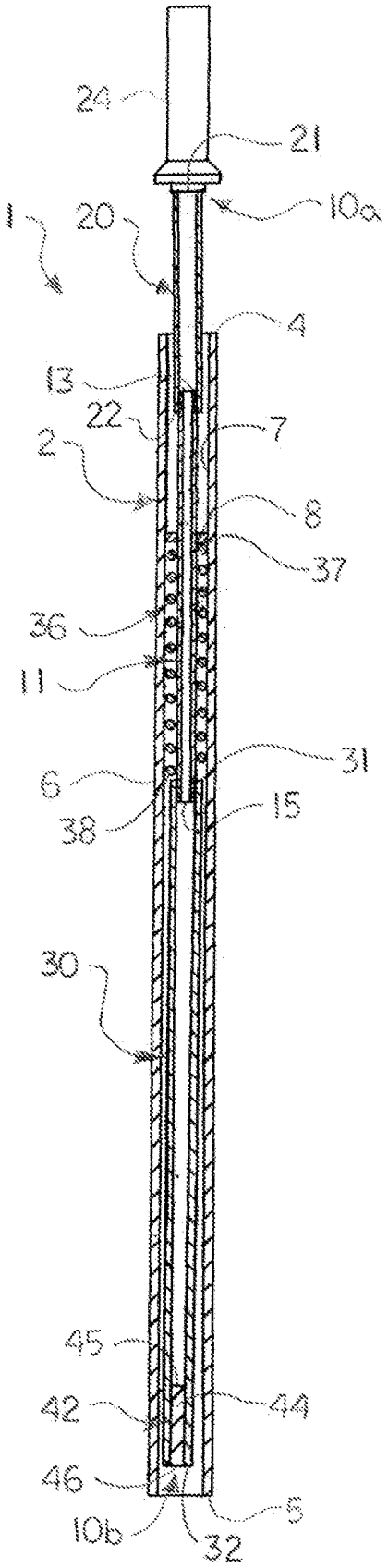
FIG. 6 is a longitudinal sectional view, taken along section lines 6-6 in FIG. 2, of the illustrative pickup stick assembly in the retracted, object-discharging configuration.

As illustrated in FIGS. 1-9, the assembly housing 2 may have an assembly housing wall 3 which may be elongated and cylindrical with the proximal housing end 4 and the distal housing end 5. As illustrated in FIGS. 5 and 6, a housing bore 7 may be formed by the assembly housing wall 3. The housing bore 7 may extend from the proximal housing end 4 to the distal housing end 5. In the extended shaft position, the assembly shaft 10 may protrude from the housing bore 7 beyond the distal housing end 5 of the assembly housing 2. In the retracted shaft position of the assembly shaft 10, the distal assembly shaft end 10*b* may be recessed in the housing bore 7 with respect to the distal housing end 5 of the assembly housing 2.

As illustrated in FIGS. 5, 6, 8 and 9, the spring retaining member 8 may extend inwardly from the assembly housing wall 3 into the housing bore 7 between the proximal housing end 4 and the distal housing end 5 of the assembly housing 2. In some embodiments, the spring retaining member 8 may be disposed between the proximal housing end 4 and a housing midpoint 6 which is halfway between the proximal housing end 4 and the distal housing end 5. The spring retaining member 8 may be attached to the interior surface of the assembly housing wall 3 using mechanical fasteners, welding and/or other suitable techniques, or may be fabricated in one piece with the assembly housing wall 3 according to the knowledge of those skilled in the art.

As illustrated in FIGS. 8 and 9, the spring retaining member 8 may have a shaft opening 9 which is sized and configured to receive and accommodate the assembly shaft 10. The assembly shaft 10 may be slidably disposed in the housing bore 7 of the assembly housing 2 and the shaft opening 9 of the spring retaining member 8 for deployment of the assembly shaft 10 between the extended shaft position and the retracted shaft position.

As illustrated in FIGS. 3-6, in some embodiments, the assembly shaft 10 may include an elongated center shaft segment 11 having a proximal center shaft segment end 12 and an opposite distal center shaft segment end 14. A handle shaft segment 20 may extend from the proximal center shaft segment end 12 of the center shaft segment 11. A terminal shaft segment 30 may extend from the distal center shaft segment end 14 of the center shaft segment 11. The center shaft segment 11 may have a width or diameter which is less than that of each of the handle shaft segment 20 and the terminal shaft segment 30. Accordingly, as illustrated in FIGS. 8 and 9, the shaft opening 9 of the spring retaining member 8 may be suitably sized and configured to accommodate the center shaft segment 11.

Figure 3:
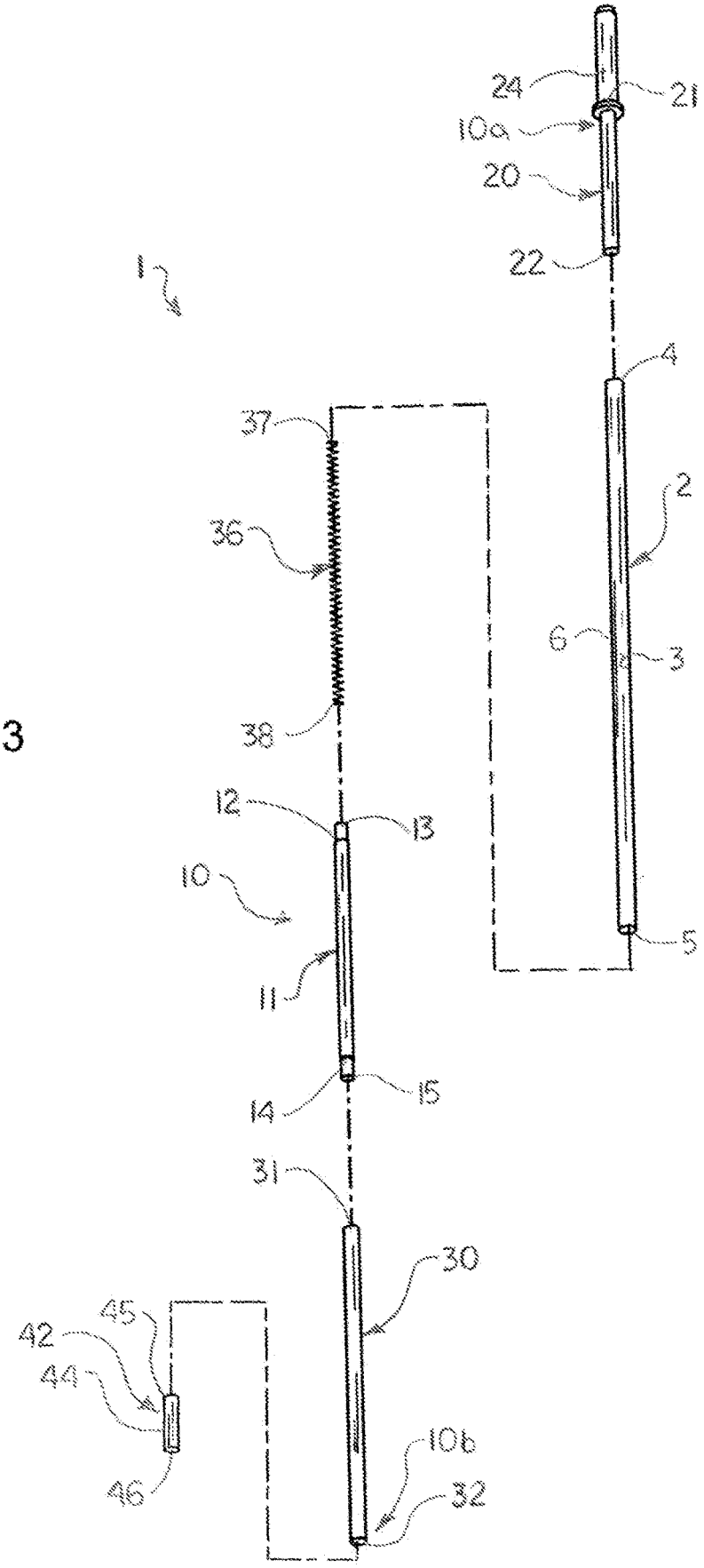
FIG. 3 is an exploded side perspective view of the illustrative pickup stick assembly.
Figure 4:
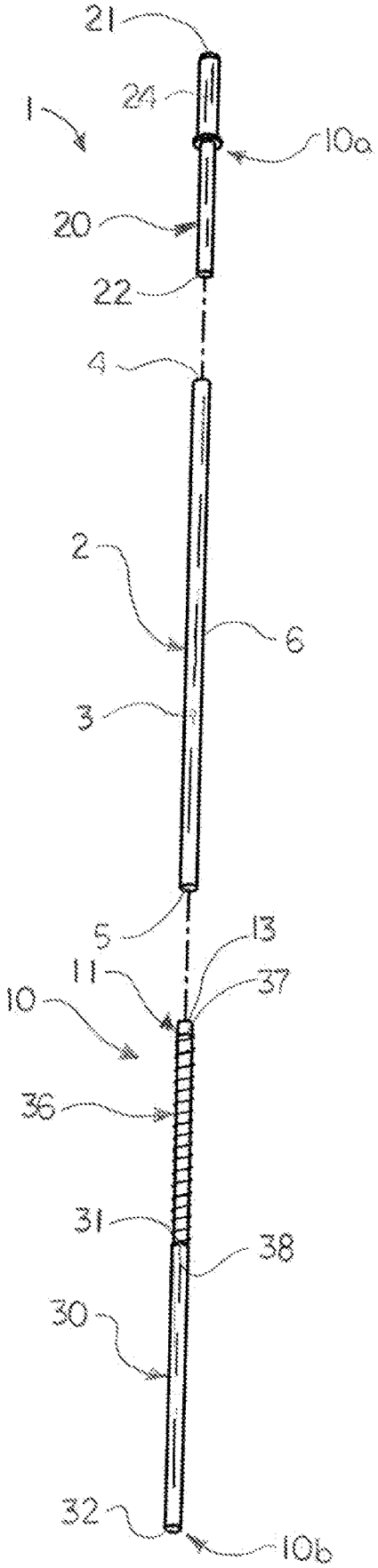
FIG. 4 is an exploded side perspective view of the partially assembled pickup stick assembly.

As illustrated in FIG. 3, the handle shaft segment 20 may have a proximal handle shaft segment end 21 and an opposite distal handle shaft segment end 22 which adjoins or abuts the proximal center shaft segment end 12 of the center shaft segment 11. The handle 24 may be provided at the proximal handle shaft end 21 of the handle shaft segment 20. The terminal shaft segment 30 may have a proximal terminal shaft segment end 31 which adjoins or abuts the distal center shaft segment end 14 of the center shaft segment 11 and an opposite distal terminal shaft segment end 32. As illustrated in FIG. 8, in the extended shaft position, the distal handle shaft segment end 22 of the handle shaft segment 20 may engage the spring retaining member 8, which may form a stop to prevent further extension of the terminal shaft segment 30 beyond the distal housing end 5 of the assembly housing 2.

In some embodiments, the distal handle shaft segment end 22 of the handle shaft segment 20 may be detachably attached to the proximal center shaft segment end 12 of the center shaft segment 11. Accordingly, as illustrated in FIG. 3, the center shaft segment 11 of the assembly shaft 10 may include a proximal center shaft segment nipple 13 which extends from the proximal center shaft segment end 12. The proximal center shaft segment nipple 13 may be sized and configured for insertion into the distal handle shaft segment end 22 of the handle shaft segment 20. The terminal shaft segment 30 may be detachably attached to the distal center shaft segment end 14 of the center shaft segment 11. A distal center shaft segment nipple 15 may extend from the distal center shaft segment end 14. The distal center shaft segment nipple 15 may be sized and configured for insertion into the proximal terminal shaft segment end 31 of the terminal shaft segment 30.

In some embodiments, the handle shaft segment 20 and the terminal shaft segment 30 may be threadably attached to the center shaft segment 11 of the assembly shaft 10. Accordingly, as illustrated in FIG. 8, in some embodiments, the proximal center shaft segment nipple 13 may have exterior proximal center shaft segment threads 16 which threadably engage companion interior distal threads 23 in the distal handle shaft segment end 22 of the handle shaft segment 20. The distal center shaft segment nipple 15 may have exterior distal center shaft segment threads 17 which threadably engage companion interior distal threads 26 in the proximal terminal shaft segment end 31 of the terminal shaft segment 30. In other embodiments, the handle shaft segment 20 and the terminal shaft segment 30 may be attached to the enter shaft segment 11 through a friction fit and/or other suitable fastening technique.

As further illustrated in FIGS. 3-6, 8 and 9, the shaft retention spring 36 may be disposed in the housing bore 7 of the assembly housing 2. The shaft retention spring 36 may engage the spring retaining member 8 and the assembly shaft 10 to normally bias the assembly shaft 10 in the extended shaft position. In some embodiments, the shaft retention spring 36 may have a proximal spring end 37 and a distal spring end 38. The proximal spring end 37 may engage the spring retaining member 8 of the assembly housing 2. The distal spring end 38 of the shaft retention spring 36 may engage the proximal terminal shaft segment end 31 of the terminal shaft segment 30 of the assembly shaft 10. As illustrated in FIGS. 5 and 6, the center shaft segment 11 of the assembly shaft 10 may extend through the shaft opening 9 of the spring retaining member 8 and longitudinally through the shaft retention spring 36 to the proximal terminal shaft segment end 31 of the terminal shaft segment 30. Accordingly, as the assembly shaft 10 is deployed from the extended shaft position to the retracted shaft position, against the bias imparted by the shaft retention spring 36, the center shaft segment 11 may slide through the shaft opening 9 in the spring retaining member 8. Simultaneously, the shaft retention spring 36 may be compressed between the spring retaining member 8 and the proximal terminal shaft member end 31 of the terminal shaft segment 30 as the proximal terminal shaft member end 31 approaches the spring retaining member 8 in the housing bore 7.

Figure 7:
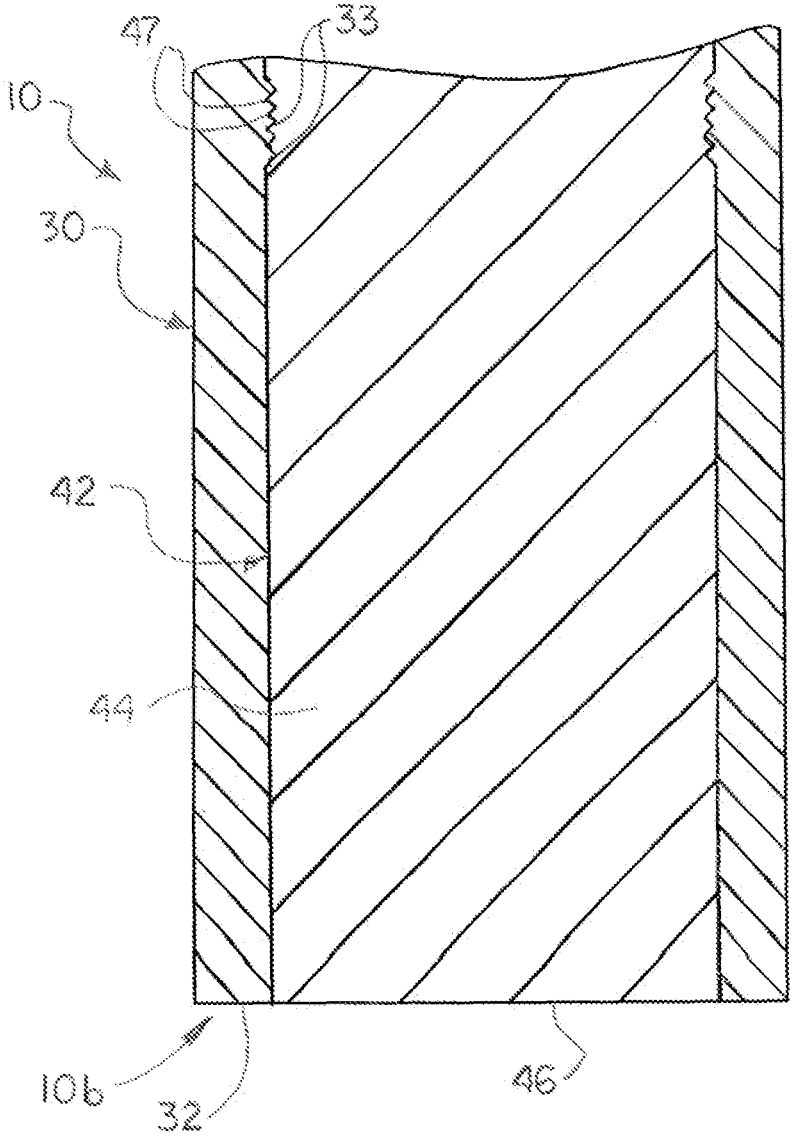
FIG. 7 is an enlarged sectional view, taken along section line 7 in FIG. 5, more particularly illustrating a typical thread technique for mounting the pick-up magnet inside the terminal shaft segment of the assembly shaft.

As illustrated in FIGS. 5 and 6, the pickup magnet 44 of the object retaining member 42 may have a proximal magnet end 45 and a distal magnet end 46. The distal magnet end 46 may be flush with or proximate to the distal terminal shaft segment end 32 of the terminal shaft segment 30 of the assembly shaft 10. The pickup magnet 44 may be mounted in the terminal shaft segment 30 using any suitable technique known by those skilled in the art. As illustrated in FIG. 7, in some embodiments, exterior magnet threads 47 on the pickup magnet 44 may engage companion interior terminal shaft segment threads 33 in the terminal shaft segment 30. Other techniques which may be used to mount the pickup magnet 44 in the terminal shaft segment 30 may include but are not limited to welding, retaining pins and the like.

As illustrated in FIG. 3, in typical assembly of the pickup stick assembly 1, the pickup magnet 44 of the object retaining member 42 may be inserted and secured in the distal shaft segment end 32 of the terminal shaft segment 30. The terminal shaft segment 30 may be attached to the distal center shaft segment end 14 of the center shaft segment 11 typically via the distal center shaft segment nipple 15. The terminal shaft segment 30 may be rotated with respect to the center shaft segment 11 to facilitate engagement of the distal threads 26 (FIG. 8) in the proximal terminal shaft segment end 31 of the terminal shaft segment 30 with the distal center shaft segment threads 17 on the distal center shaft segment nipple 15 of the center shaft segment 11.

The distal spring end 38 of the shaft return spring 36 may next be placed over the proximal center shaft segment nipple 13 and into engagement with the proximal center shaft segment end 12 of the center shaft segment 11. The proximal spring end 37 of the shaft return spring 36, followed by the center shaft segment 11 and the terminal shaft segment 30, respectively, of the assembly shaft 10, may then be inserted through the distal housing end 5 into the housing bore 7 of the assembly housing 2. As the center shaft segment 11 inserts through the shaft opening 9 of the spring retaining member 8 in the housing bore 7 of the assembly housing 2, the shaft return spring 36 may be compressed between the proximal terminal shaft segment end 31 of the terminal shaft segment 30 and the spring retaining member 8.

The distal handle shaft segment end 22 on the handle shaft segment 20 of the assembly shaft 10 may next be inserted through the proximal housing end 4 into the housing bore 7 of the assembly housing 2 until the proximal center shaft segment nipple 13 on the proximal center shaft segment end 12 of the center shaft segment 11 inserts into the distal handle shaft segment end 22 of the handle shaft segment 20. The handle shaft segment 20 may be rotated with respect to the center shaft segment 11 to facilitate engagement of the proximal center shaft segment threads 16 (FIG. 8) on the proximal enter shaft segment nipple 13 of the center shaft segment 11 with the distal threads 13 in the distal handle shaft segment end 22 of the handle shaft segment 20.

Figure 1:
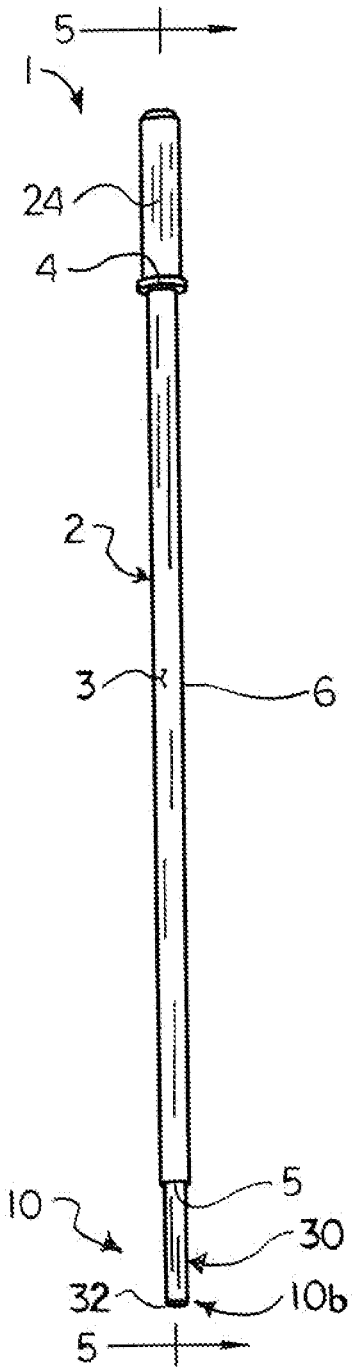
FIG. 1 is a side perspective view of an illustrative embodiment of the pickup stick assemblies, disposed in an object-retrieving configuration.
Figure 2:
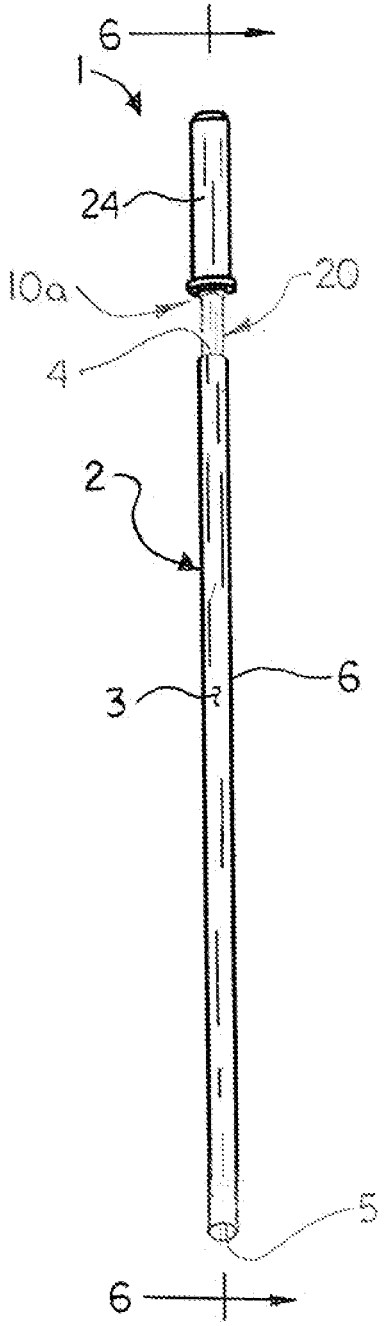
FIG. 2 is a side view of the illustrative pickup stick assembly illustrated in FIG. 1, disposed in an object-discharging configuration.

In typical application, the pickup stick assembly 1 may be operated to pick up objects 50 such as spent shotgun shells, for example and without limitation, as illustrated in FIG. 10, from the ground and deposit or discharge the objects 50 into a trash or other receptacle (not illustrated) without the need of the operator of the pickup stick assembly 1 to squat or bend over to retrieve the objects 50 with the operator's hands. Accordingly, the operator (not illustrated) of the pickup stick assembly 1 may grasp the handle 24 with one hand and the assembly housing 2 with the other hand. As illustrated in FIGS. 1, 5 and 8, the shaft return spring 36 normally biases the assembly shaft 10 in the extended shaft position such that the distal terminal shaft segment end 32 of the terminal shaft segment 30 on the assembly shaft 10 protrudes beyond the distal housing end 5 of the assembly housing 2. The portion of the terminal shaft segment 30 which extends beyond the distal housing end 5 may correspond to at least a portion of the length of the pickup magnet 44. Accordingly, the magnetic field of the pickup magnet 44 may transmit through the wall of the terminal shaft segment 30 to the outer surface of the terminal shaft segment 30.

The operator may place the protruding end portion of the terminal shaft segment 30 above or adjacent to the objects 50 as the objects 50 typically lie in a scattered pattern on the ground. Accordingly, as illustrated in FIG. 10, the pickup magnet 44 magnetically attracts the objects 50 such that the objects 50 are magnetically attached to and typically extend outwardly from the terminal shaft segment 30. The operator may carry the pickup stick assembly 1 to a suitable trash or other receptacle (not illustrated) and place the distal housing end 5 of the assembly housing 2, with the terminal shaft segment 30 protruding therefrom, over the receptacle. As the operator of the pickup stick assembly 1 continues to grip the handle 24 with one hand, the operator may continue to grip the assembly housing 2 with the other hand and either pull the assembly shaft 10 rearwardly or proximally with respect to the assembly housing 2 or slide the assembly housing 2 forwardly or distally with respect to the assembly shaft 10. Thus, the assembly shaft 10 deploys from the extended shaft position to the retracted shaft position illustrated in FIGS. 2 and 6. Consequently, as illustrated in FIG. 11, the distal housing end 5 of the assembly housing 2 may travel along the protruding end portion of the terminal shaft segment 30 to the distal terminal shaft segment end 32. Accordingly, the distal housing end 5 of the sliding terminal shaft segment 30 slides and dislodges the objects 50 from the terminal shaft segment 30 into the receptacle. The operator of the pickup stick assembly 1 may subsequently release the assembly shaft 10 or the assembly housing 2 such that the shaft return spring 36 returns the assembly shaft 10 to the retracted shaft position. The pickup stick assembly 1 may then be used to retrieve and discard other objects 50 or other magnetized objects, typically in like manner.

Figure 12:
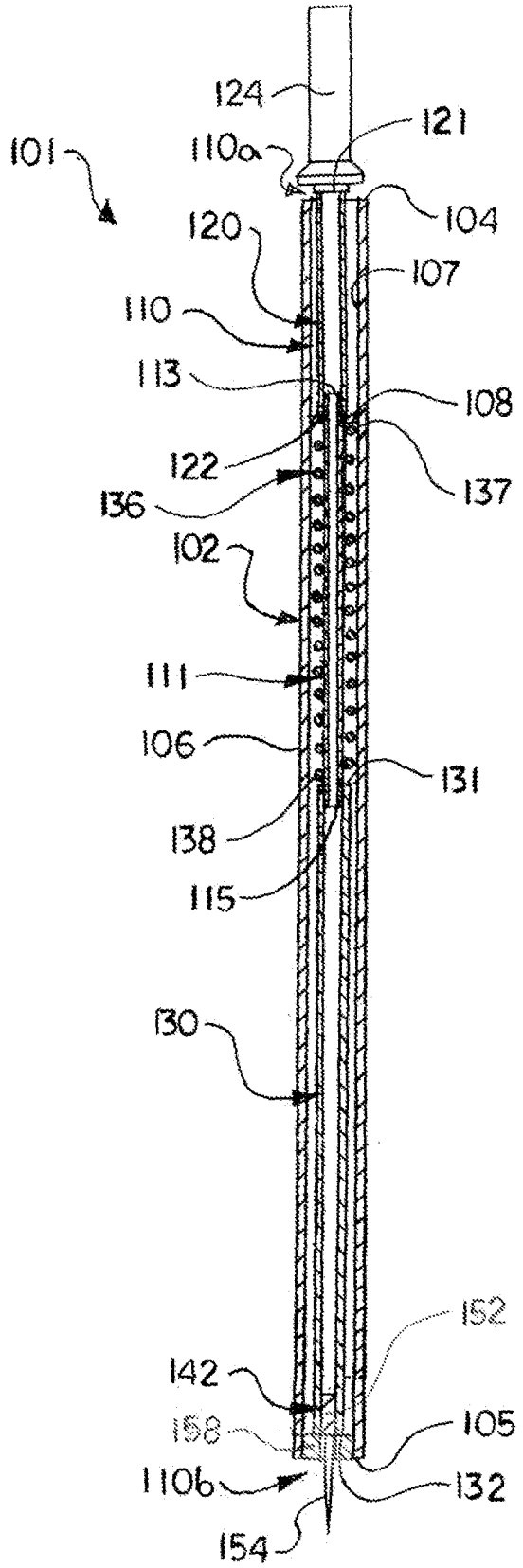
FIG. 12 is a longitudinal sectional view of another illustrative embodiment of the pickup stick assemblies in the object-retrieving configuration of the assembly.
Figure 13:
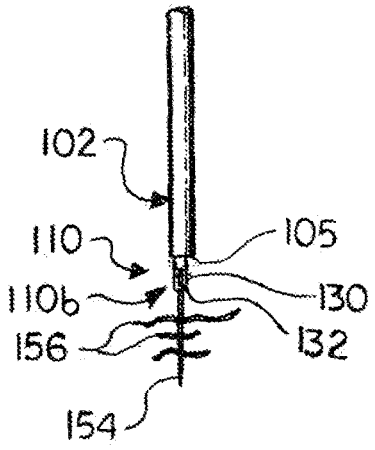
FIG. 13 is an enlarged sectional view of the pickup spike of the pickup stick assembly illustrated in FIG. 12, with multiple pieces of trash impaled on the spike in typical application of the assembly.
Figure 14:
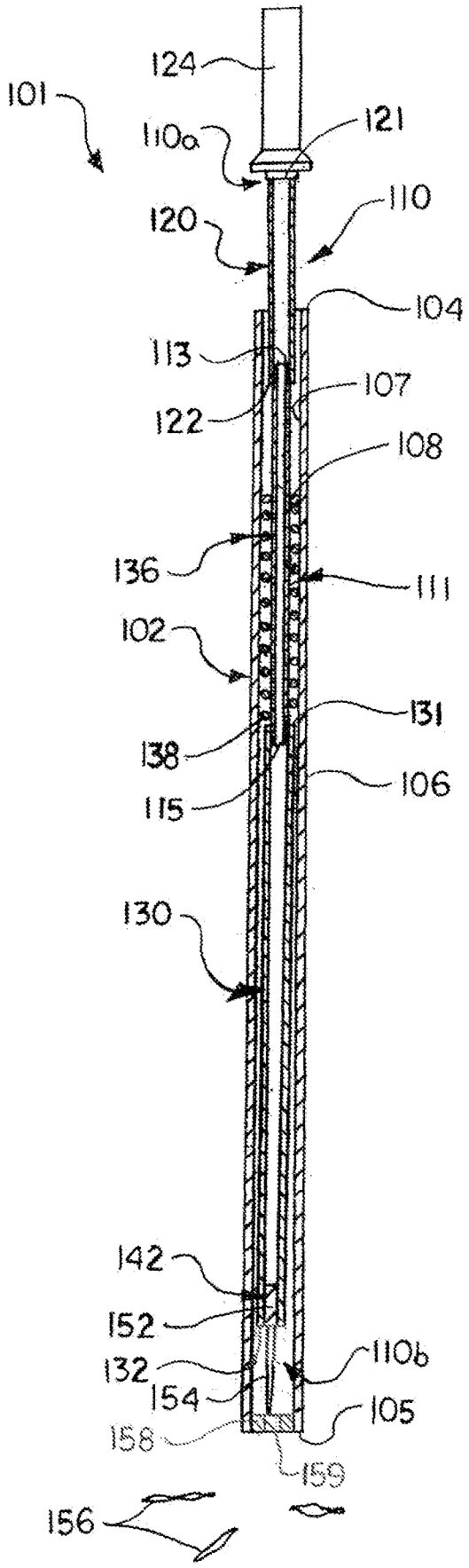
FIG. 14 is a longitudinal sectional view of the illustrative pickup stick assembly illustrated in FIG. 13 in the object-discharging configuration of the assembly to discharge the impaled trash from the pickup spike.

Referring next to FIGS. 12-14 of the drawings, an alternative illustrative embodiment of the pickup stick assemblies is generally indicated by reference numeral 101. In the pickup stick assembly 101, elements which are analogous to the respective elements of the pickup stick assembly 1 that was heretofore described with respect to FIGS. 1-11 are designated by the same respective numerals in the 101-199 series in FIGS. 12-14. The object retaining member 142 of the pickup stick assembly 100 may include at least one pickup spike 154. The pickup spike 154 may protrude beyond the distal terminal shaft segment end 132 of the terminal shaft segment 130. In the extended shaft position of the assembly shaft 110, illustrated in FIGS. 12 and 13, the pickup spike 154 may protrude beyond the distal housing end 105 of the assembly housing 102. In the retracted shaft position of the assembly shaft 110, illustrated in FIG. 14, the pickup spike 154 may be retracted with respect to the distal housing end 105 and disposed in the housing bore 107 of the assembly housing 102.

The pickup spike 154 may be mounted in the terminal shaft segment 130 of the assembly shaft 110 according to the knowledge of those skilled in the art. Accordingly, in some embodiments, a spike mount member 152 may be threaded, welded, pinned and/or otherwise fastened in the distal terminal shaft segment end 132 of the terminal shaft segment 130. The pickup spike 154 may extend from the spike mount member 152.

Application of the pickup stick assembly 101 may be as was heretofore described with respect to that of the pickup stick assembly 1 in FIGS. 1-11. As illustrated in FIG. 12, the shaft return spring 136 may normally bias and maintain the assembly shaft 110 in the retracted shaft position in the housing bore 107 of the assembly housing 102. The operator of the pickup stick assembly 101 may grasp the handle 124 with one hand and the assembly housing 102 with the other hand and impale trash or other objects 156 to be retrieved from the ground with the protruding pickup spike 154. The operator may then deploy the assembly shaft 110 from the extended shaft position in FIGS. 12 and 13 to the retracted shaft position illustrated in in FIG. 14 such that the distal housing end 105 of the assembly housing 102 slides the impaled objects 156 from the pickup spike 154 typically into a trash or other receptacle (not illustrated). The operator of the pickup stick assembly 101 may subsequently release the assembly shaft 110 or the assembly housing 102 such that the shaft return spring 136 returns the assembly shaft 110 to the retracted shaft position. The pickup stick assembly 101 may then be used to impale and discard other trash or other objects 156, typically in like manner.

As illustrated in FIGS. 12 and 14, in some embodiments, a spike bushing 158 may be provided in the housing bore 107 at the distal housing end 105 of the assembly housing 102. As illustrated in FIG. 14, the spike bushing 158 may have a bushing opening 159. The bushing opening 159 may be suitably sized and configured to receive and accommodate the pickup spike 154 in the extended shaft position of the assembly shaft 110, as illustrated in FIG. 12. As the assembly shaft 110 returns from the extended shaft position to the retracted shaft position, as illustrated in FIG. 14, the spike bushing 158 may remove trash 156 which remains impaled on the pickup spike 154 to clean the pickup spike 154.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A pickup stick assembly, comprising:

an assembly housing comprising:

a proximal housing end;

a distal housing end; and a spring retaining member between the proximal housing end and the distal housing end;

an assembly shaft slidably disposed in the assembly housing and having a proximal assembly shaft end protruding beyond the proximal housing end of the assembly housing and a distal assembly shaft end opposite the proximal assembly shaft end, the assembly shaft deployable in an extended shaft position wherein the distal assembly shaft end protrudes beyond the distal housing end of the assembly housing and a retracted shaft position wherein the distal assembly shaft end is recessed with respect to the distal housing end of the assembly housing;

a shaft retention spring in the assembly housing, the shaft retention spring engaging the spring retaining member and the assembly shaft and normally biasing the assembly shaft in the extended shaft position; and at least one object retaining member carried by the assembly shaft at the distal assembly shaft end.

2. The pickup stick assembly of claim 1 further comprising a handle at the proximal assembly shaft end of the assembly shaft.

3. The pickup stick assembly of claim 1 wherein the at least one object retaining member is a pickup magnet or a pickup spike.

4. The pickup stick assembly of claim 1 wherein the assembly shaft comprises a center shaft segment having a proximal center shaft segment end and a distal center shaft segment end, a handle shaft segment extending from the proximal center shaft segment end and a terminal shaft segment extending from the distal center shaft segment end.

5. The pickup stick assembly of claim 4 wherein the handle shaft segment is detachably attached to the proximal center shaft segment end and the terminal shaft segment is detachably attached to the distal center shaft segment end of the center shaft segment.

6. The pickup stick assembly of claim 5 wherein the center shaft segment comprises a proximal center shaft segment nipple extending from the proximal center shaft segment end and engaging the handle shaft segment and a distal center shaft segment nipple extending from the distal center shaft segment end and engaging the terminal shaft segment.

7. The pickup stick assembly of claim 4 wherein the terminal shaft segment of the assembly shaft comprises a proximal terminal shaft segment end attached to the distal center shaft segment end of the center shaft segment and a distal terminal shaft segment end opposite the proximal terminal shaft segment end, and the shaft return spring engages the spring retaining member and the proximal terminal shaft segment end of the terminal shaft segment.

8. The pickup stick assembly of claim 7 wherein the shaft return spring comprises a proximal spring end engaging the spring retaining member and a distal spring end engaging the proximal terminal shaft segment end of the terminal shaft segment.

9. A pickup stick assembly, comprising:

an assembly housing comprising:

a proximal housing end;

a distal housing end; and a spring retaining member in the assembly housing between the proximal housing end and the distal housing end, the spring retaining member having a shaft opening;

an assembly shaft slidably disposed in the assembly housing and the shaft opening of the spring retaining member and having a proximal assembly shaft end protruding beyond the proximal housing end of the assembly housing and a distal assembly shaft end opposite the proximal assembly shaft end, the assembly shaft deployable in an extended shaft position wherein the distal assembly shaft end protrudes beyond the distal housing end of the assembly housing and a retracted shaft position wherein the distal assembly shaft end is recessed with respect to the distal housing end of the assembly housing;

a shaft retention spring in the assembly housing, the shaft retention spring engaging the spring retaining member of the assembly housing and the assembly shaft and normally biasing the assembly shaft in the extended shaft position; and at least one object retaining member carried by the assembly shaft at the distal assembly shaft end.

10. The pickup stick assembly of claim 9 further comprising a handle at the proximal assembly shaft end of the assembly shaft.

11. The pickup stick assembly of claim 9 wherein the at least one object retaining member is a pickup magnet or a pickup spike.

12. The pickup stick assembly of claim 9 wherein the assembly shaft comprises a center shaft segment having a proximal center shaft segment end and a distal center shaft segment end, a handle shaft segment extending from the proximal center shaft segment end and a terminal shaft segment extending from the distal center shaft segment end.

13. The pickup stick assembly of claim 12 wherein the handle shaft segment is detachably attached to the proximal center shaft segment end and the terminal shaft segment is detachably attached to the distal center shaft segment end of the center shaft segment.

14. The pickup stick assembly of claim 13 wherein the center shaft segment comprises a proximal center shaft segment nipple extending from the proximal center shaft segment end and engaging the handle shaft segment and a distal center shaft segment nipple extending from the distal center shaft segment end and engaging the terminal shaft segment.

15. The pickup stick assembly of claim 12 wherein the terminal shaft segment of the assembly shaft comprises a proximal terminal shaft segment end attached to the distal center shaft segment end of the center shaft segment and a distal terminal shaft segment end opposite the proximal terminal shaft segment end, and the shaft return spring engages the spring retaining member and the proximal terminal shaft segment end of the terminal shaft segment.

16. The pickup stick assembly of claim 15 wherein the shaft return spring comprises a proximal spring end engaging the spring retaining member and a distal spring end engaging the proximal terminal shaft segment end of the terminal shaft segment.

17. A pickup stick assembly, comprising:

an assembly housing comprising:

an assembly housing wall comprising a proximal housing end, a distal housing end and a housing midpoint between the proximal housing end and the distal housing end;

a housing bore formed by the assembly housing wall and extending from the proximal housing end to the distal housing end; and a spring retaining member extending from the assembly housing wall into the housing bore between the proximal housing end and the housing midpoint, the spring retaining member having a shaft opening;

an assembly shaft slidably disposed in the housing bore of the assembly housing and extending through the shaft opening in the spring retaining member, the assembly shaft having a proximal assembly shaft end protruding beyond the proximal housing end of the assembly housing and a distal assembly shaft end opposite the proximal assembly shaft end, the assembly shaft deployable in an extended shaft position wherein the distal assembly shaft end extends beyond the distal housing end of the assembly housing wall and a retracted shaft position wherein the distal assembly shaft end is recessed in the shaft bore with respect to the distal housing end of the assembly housing wall;

a shaft retention spring in the housing bore of the assembly housing, the shaft retention spring having a proximal spring end engaging the spring retaining member of the assembly housing and a distal spring end engaging the assembly shaft and normally biasing the assembly shaft in the extended shaft position; and a pickup magnet or a pickup spike carried by the assembly shaft at the distal assembly shaft end.

18. The pickup stick assembly of claim 17 further comprising a handle at the proximal assembly shaft end of the assembly shaft.

19. The pickup stick assembly of claim 17 wherein the assembly shaft comprises a center shaft segment having a proximal center shaft segment end and a distal center shaft segment end, a handle shaft segment extending from the proximal center shaft segment end and a terminal shaft segment extending from the distal center shaft segment end, and the distal spring end of the shaft retention spring engages the terminal shaft segment of the assembly shaft.

20. The pickup stick assembly of claim 19 wherein the center shaft segment comprises a proximal center shaft segment nipple extending from the proximal center shaft segment end and engaging the handle shaft segment and a distal center shaft segment nipple extending from the distal center shaft segment end and engaging the terminal shaft segment.

* * * * *